US007744302B2

(12) United States Patent
Rodriguez

(10) Patent No.: US 7,744,302 B2
(45) Date of Patent: Jun. 29, 2010

(54) CROSS-KEY ROTATIONAL ALIGNMENT LOCKING DEVICE FOR VSI MINERAL BREAKER

(76) Inventor: Damian Rodriguez, 263 S. Vasco Rd., Livermore, CA (US) 94551

( * ) Notice: Subject to any disclaimer, the term of this patent is extended or adjusted under 35 U.S.C. 154(b) by 95 days.

(21) Appl. No.: 11/823,532

(22) Filed: Jun. 27, 2007

(65) Prior Publication Data

US 2009/0000341 A1 Jan. 1, 2009

(51) Int. Cl.
*B02C 1/08* (2006.01)

(52) U.S. Cl. ..... 403/355; 403/365; 403/370; 241/278.1; 175/415

(58) Field of Classification Search ..... 403/355, 403/365, 369, 370, 371, 383; 241/191, 277, 241/278.1; 175/320, 415; 405/256; 299/41.1
See application file for complete search history.

(56) References Cited

U.S. PATENT DOCUMENTS 3,920,089 A * 11/1975 Mitchell ..... 175/320
3,993,147 A * 11/1976 Mitchell ..... 175/344
5,826,523 A * 10/1998 Gregor ..... 111/181
6,749,386 B2 * 6/2004 Harris ..... 411/544
6,786,671 B1 * 9/2004 Eckendorff ..... 403/365

* cited by examiner

*Primary Examiner*—Michael P Ferguson
(74) *Attorney, Agent, or Firm*—Brian Beverly; Beeson Skinner Beverly

(57) ABSTRACT

A cross-key rotational alignment locking device for a VSI-type mineral breaker comprises a generally annular keyway 102 in the top edge portion of the main shaft 12 of the breaker, the annular keyway defining an upwardly extending pilot key 104, a plurality of circumferentially spaced slots 126 in the upper portion of a cylindrical taper lock 108 disposed around the main shaft, the slots in communication with the annular keyway, and a cross-key 130 having a generally annular main body 132 disposed in the annular keyway 102, the pilot key 104 received in a central aperture 136 in the main body 132 of the cross-key 130, and the cross-key having a plurality of radially-extending arms 128 disposed in the plurality of slots 126, such that the taper lock 108 is locked in rotational alignment with the shaft 12. In the preferred embodiment a bronze sleeve 110 having a longitudinally extending split 120 is interposed between the taper lock 108 and the shaft 12.

25 Claims, 8 Drawing Sheets

CROSS-KEY ROTATIONAL ALIGNMENT LOCKING DEVICE FOR VSI MINERAL BREAKER

FIELD OF THE INVENTION

This invention is directed to vertical shaft impact (VSI) mineral breakers and in particular to locking devices to secure components of the taper lock assembly, shaft and rotor of a VSI mineral breaker in rotational alignment.

BACKGROUND

VSI-type mineral breakers operate as high-speed "rock pumps". The receipt, acceleration and discharge of the rock feed introduced to this type of rock crusher passes through a rotating impeller more accurately described as a rock-lined rotor. This rotor is supported in the machine by a main shaft 12 which is held and turns in a bearing cartridge assembly 14, as shown in FIGS. 1-4, in a housing (not illustrated) centered within the machine. The rotating shaft 12 imparts torque onto the spinning impeller or rotor 44. The initial point of impact for the incoming rock mineral feed is the center of the rock-lined rotor directly below which is a mechanical connection between the rotor 44 and the shaft 12.

A popular method of affixing the rotor 44 to the shaft 12 is by the use of a taper lock type of arrangement in which a tapered outer surface 16 of a taper lock 18 and a cooperating tapered inner surface 20 of a rotor boss 22 are drawn together using a top plate 24 and several bolts 26, 28. See FIGS. 2 and 3. Commonly, the taper lock 18 is installed on and around the upper end of shaft 12. Then the rotor boss 22, which is very firmly attached to the rotor 44, is lowered over and around taper lock 18. Top plate 24 is then secured to rotor boss 22 with a first set of bolts 26 which pass through outer apertures 27 in top plate 24 and are threaded into bolt holes 46 in rotor boss 22. A second set of bolts 28 passes through inner apertures 29 in top plate 24 and is threaded into bolt holes 48 in taper lock 18. As the second set of bolts 28 are tightened, top plate 24 and rotor boss 22 are drawn downward towards taper lock 18. When properly tightened, the bolts 26, 28 cause a sliding interference fit between the outer surface 16 of the taper lock 18 and the inner surface 20 of the rotor boss 22. Since taper lock 18 is provided with a longitudinal split 30, as the rotor boss 22 is forced downward, the circumference of taper lock 18 is reduced allowing the taper lock to be physically compressed around the shaft 12. A taper lock fitting thus establishes maximum surface contact between the adjoining parts and achieves a high-pressure, compressed, non-slipping joint through which driving torque is transferred from the shaft 12 to the rotor 44. In addition to providing a strong mechanical joint between the taper lock 18 and the rotor boss 22, use of the taper lock joint allows for easy disassembly of the parts by loosening the bolts which draw the tapered surfaces 16, 20 of the taper lock 18 and the rotor boss 22 together. Thereafter, a small amount of axial movement relieves compression at the tapered surfaces.

A conventional key system acts as a backup to minimize or eliminate any rotational slipping between the parts, ensuring that all the components rotate as one. The taper lock 18 is keyed to the shaft 12 using a longitudinal keyway 32 in the shaft 12 into which is fitted a key 34. There is a mating keyway 36 in the bore 38 of the taper lock 18 which matches and slides over key 34. This forms a positive mechanical connection between the shaft 12 and the impeller or rotor 44. See FIGS. 1-4.

While the conventional taper lock-and-keyway design is effective and generally reliable, it is not ideal for application in a VSI-type mineral breaker where extensive vibrational forces and unpredictable shock loadings routinely occur. Due to manufacturing tolerances and variances, weaknesses can develop that undermine the system. Minute differences between the exterior surface of the shaft and the interior surface of the taper lock lead to "fretting," the microscopic movement of material under high pressure. Poorly machined surfaces can lead to "notches" in the shaft, along the shaft keyway, or in the taper lock bore. As the shaft is typically a hardened steel alloy, it is vulnerable to the phenomena of "notch sensitivity." This works similarly to the etching of glass wherein a small imperfection in the material may become the focal point for cracking and part failure. Extended use can result in pitting and poor surface conditions. Finally, experience has shown that a high proportion of shaft failures occur in that portion of the shaft adjacent the bottom of the taper lock where a bending moment is formed by the collective weight of the taper lock 18, rotor boss 22, and rotor 44 resting on the shaft 12. In concert, these irregularities can cause unique loading conditions and stress concentrations which may result in shaft failure. One of the factors that can accelerate failure of the shaft is the introduction of heat 30° F. or more above ambient temperature as the result of drying mineral feed entering the breaker. This added temperature causes the rotor boss 22 to expand resulting in a relaxation of the interference fit in the taper lock joint and consequent loosening of the taper lock's grip on the shaft, frequently leading to fretting of the contact surfaces.

In the normal operation of a VSI-type mineral breaker, the impeller or rotor is routinely removed and re-installed for purposes of maintenance. In some instances, multiple impellers or rotors may be applied to the same shaft and taper lock. All of this removal and re-installation distresses the parts of the taper lock assembly, especially the main shaft, with the result that, as the VSI mineral breaker ages, the main shaft becomes more vulnerable.

SUMMARY OF THE INVENTION

A cross-key rotational alignment locking device provides a system that protects the main shaft from the types of distress discussed above that can lead to premature failure.

The cross-key arrangement eliminates the longitudinal keyway 32 in the shaft 12, maintaining the shaft at its full diameter for maximum strength and structural integrity. The interior taper of the rotor boss 22 remains the same as in the conventional system, and the taper on the exterior 16 of the taper lock 18 is also retained. The same compression forces achieved by use of the top plate 24 lock the assembly together as one, but the back up system to eliminate any rotational slipping is changed. This is done by machining a square pilot key on the top end of the shaft over which a generally cross-shaped key (the "cross-key") is placed. The cross-key mates to the shaft by fitting a square hole in its center over the square pilot key on the shaft. Locking to the taper lock is achieved by four outwardly-extending arms of the cross-key which engage four cooperating slots machined into the annular upper portion of the taper lock. The cross-key design aligns all components simply and reliably and does not interfere with the ability to loosen the taper lock assembly's grip on the shaft quickly by axial movement of the taper lock and rotor boss as when using the conventional key design.

An important new feature of the cross-key design is the use of a bronze sleeve which is positioned around the top end of the shaft inside the taper lock. The sleeve is longitudinally split to allow for compression by the taper lock, thereby permitting it to achieve a firm grip on the shaft. The bronze sleeve, being of more malleable material than the steel used to form the shaft and taper lock, readily conforms to any irregularities on the surface of the shaft or the bore of the taper lock, assuring a firmer grip by the taper lock assembly on the shaft. It effectively acts as a sacrificial piece which receives any distress that may occur between the parts, thereby protecting the surface of the main shaft and bore of the taper lock from any "notches." The bronze sleeve, because of its higher coefficient of expansion when heated, will also minimize the loosening that can occur from processing heated rocks being fed into the VSI mineral breaker since it will expand quickly relative to the immediately adjacent taper lock and shaft when heated to take up any "slack" between the taper lock and shaft. Finally, the bronze sleeve is a relatively inexpensive part which is easily replaced compared with the taper lock or the main shaft of the machine.

BRIEF DESCRIPTION OF THE ILLUSTRATIONS

DETAILED DESCRIPTION OF THE ILLUSTRATED EMBODIMENT

Figure 1:
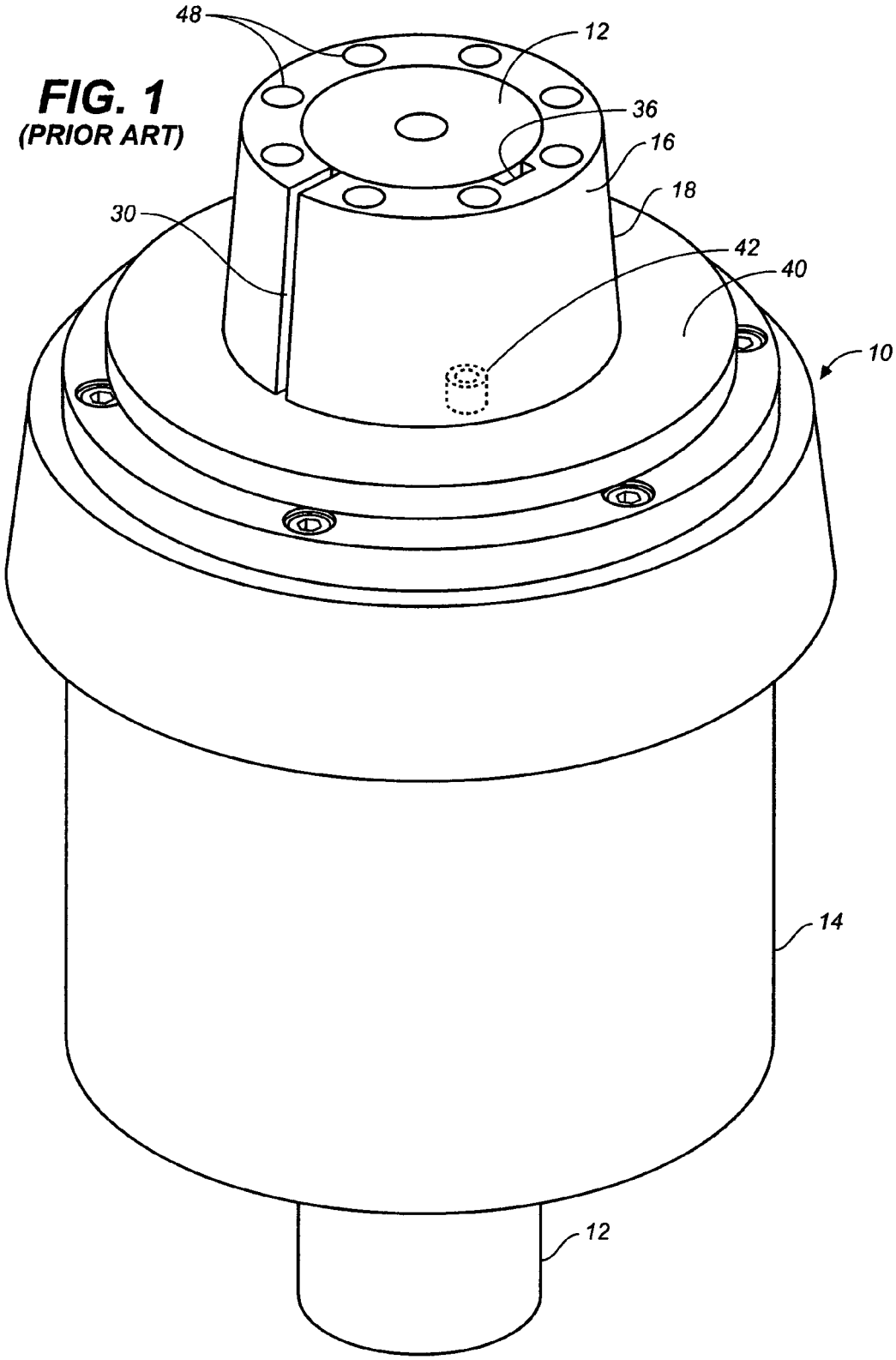
FIG. 1 (PRIOR ART)
FIG. 1 is a perspective view showing prior art core components of a VSI mineral breaker, including a bearing cartridge assembly, shaft, and taper lock.
Figure 2:
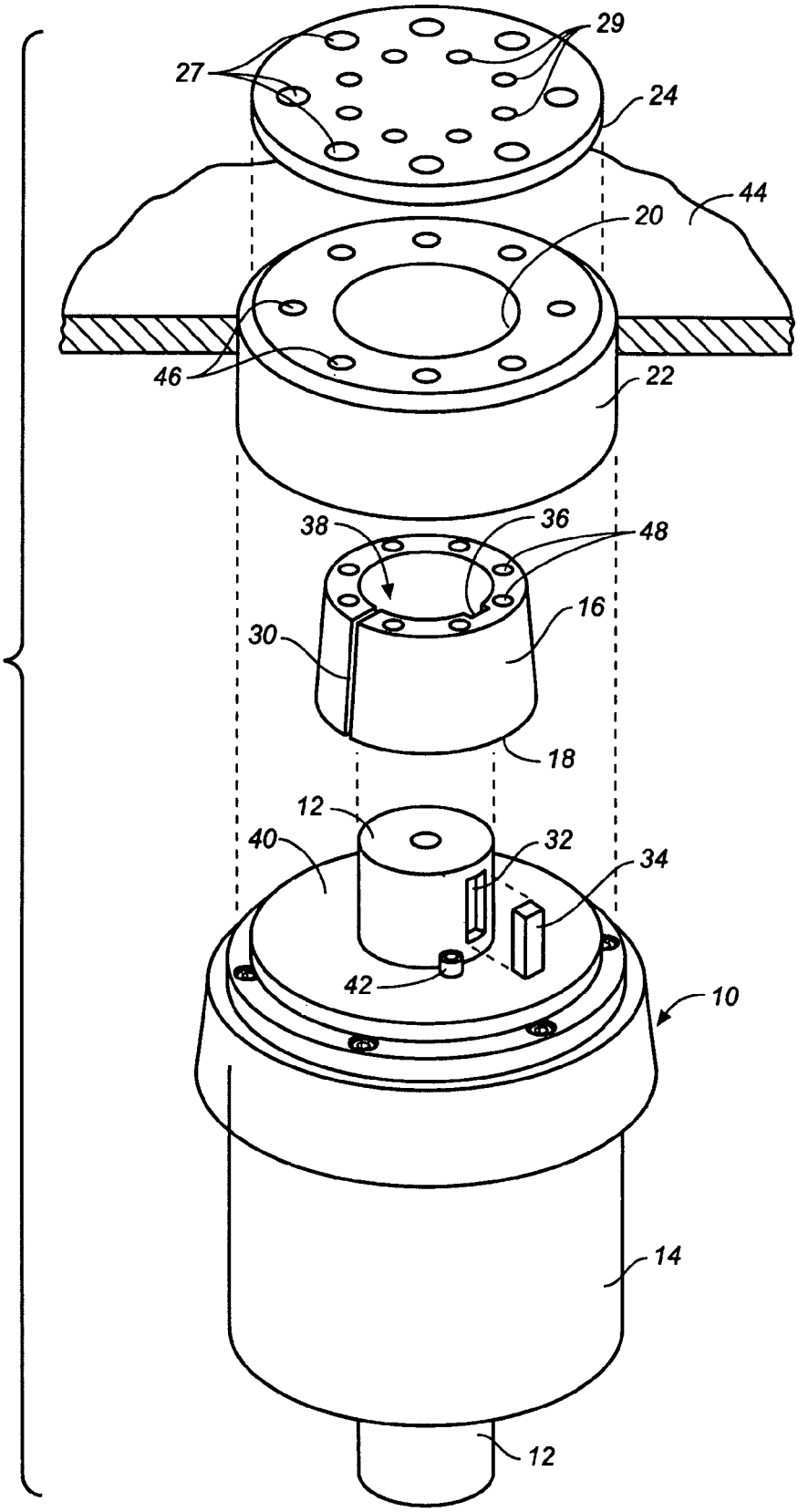
FIG. 2 (PRIOR ART)
FIG. 2 is an exploded perspective view of the VSI crusher components shown in FIG. 1 together with a rotor boss, top plate, and a portion of a rotor according to the prior art.
Figure 3:
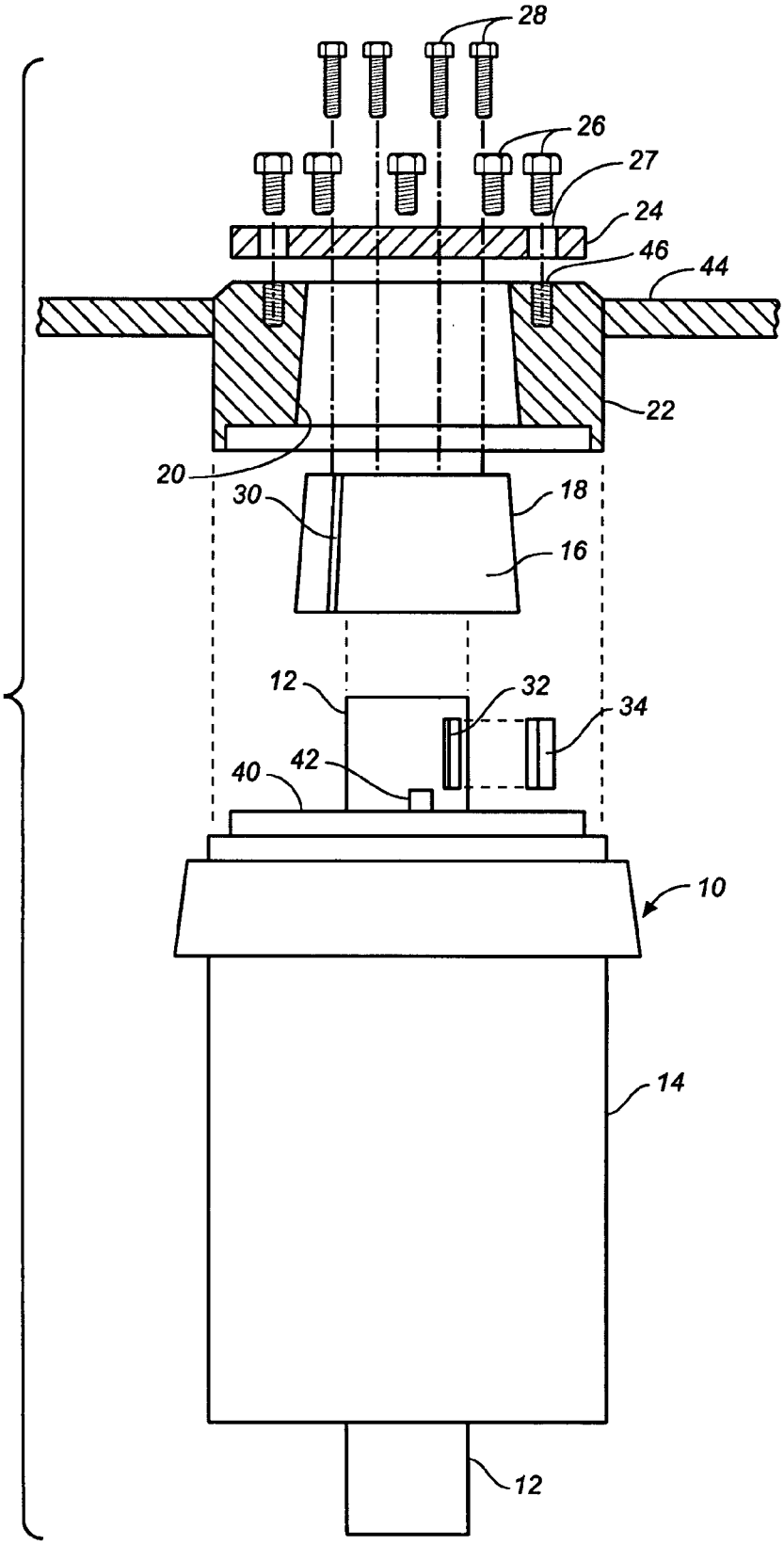
FIG. 3 (PRIOR ART)
FIG. 3 is an exploded elevation view of the prior art VSI crusher components shown in FIG. 2, also showing bolts used to join the components together, wherein the rotor boss, rotor and top plate are shown in sectional view.
Figure 4:
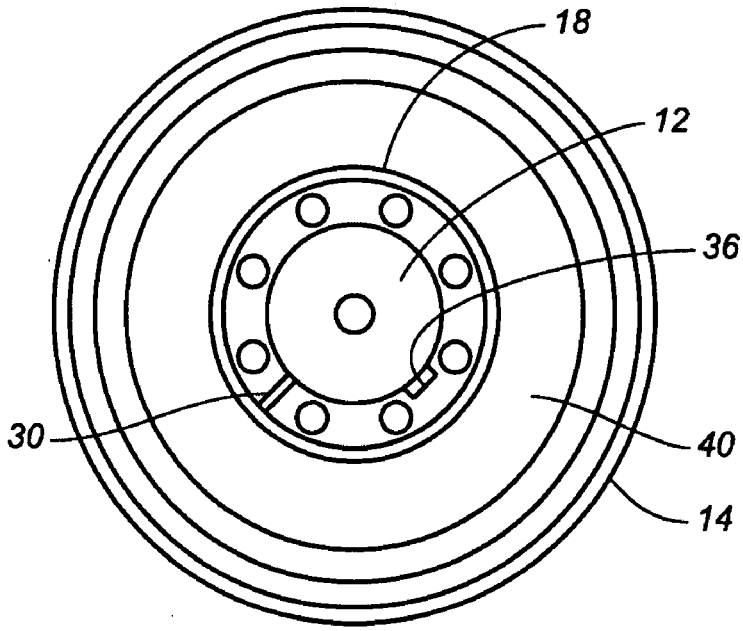
FIG. 4 (PRIOR ART)
FIG. 4 is a top plan view of the prior art VSI crusher components shown in FIG. 1.
Figure 5:
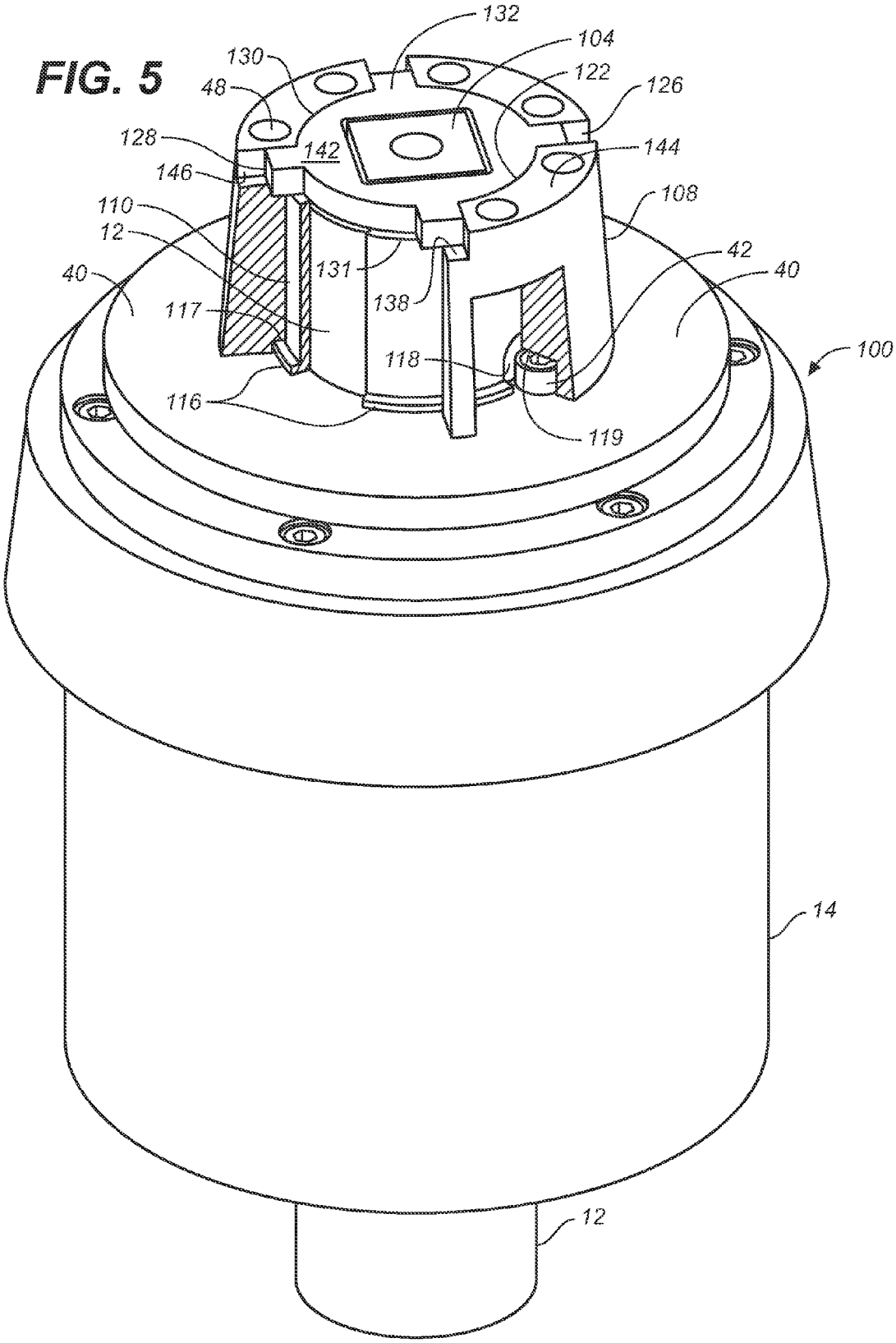
FIG. 5 is a partially cut-away upper perspective view of a cross-key rotational alignment locking device for a VSI-type mineral breaker according to the invention.

A cross-key rotational alignment locking device, according to the invention, is indicated generally at 100 in FIG. 5. For purposes of this application, the invention will be also hereinafter referred to from time-to-time as the "cross-key locking device," or simply "the invention." The cross-key locking device works in conjunction with many of the core components of VSI-type mineral breakers found in the prior art such as the shaft 12, bearing assembly 14, and rotor 44 depicted in FIGS. 1-4. The invention advantageously eliminates longitudinal keyway 32, improving the structural integrity of the top portion of shaft 12. Not only does this maximize the shaft's strength, but it eliminates a fertile ground for development of notching along the shaft keyway 32.

Figure 6:
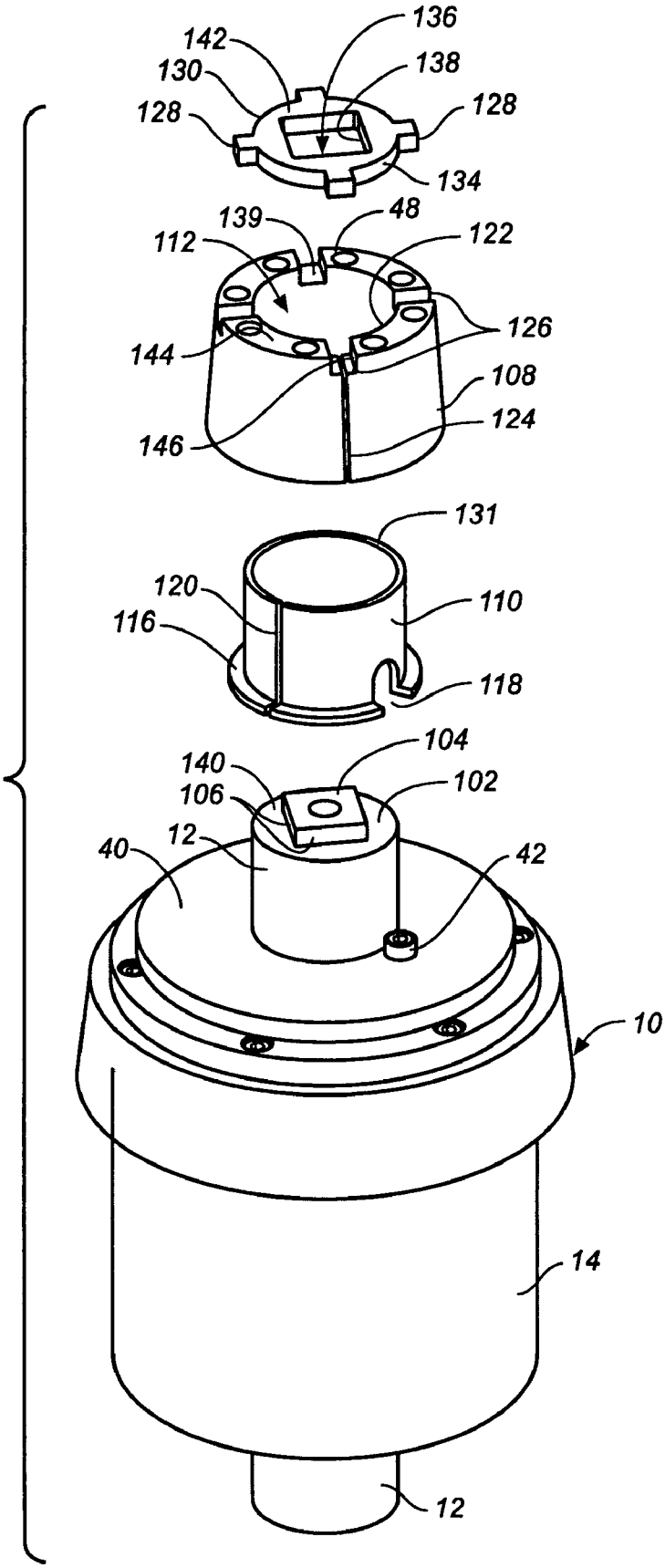
FIG. 6 is an exploded perspective view of the cross-key rotational alignment locking device shown in FIG. 5.
Figure 7:
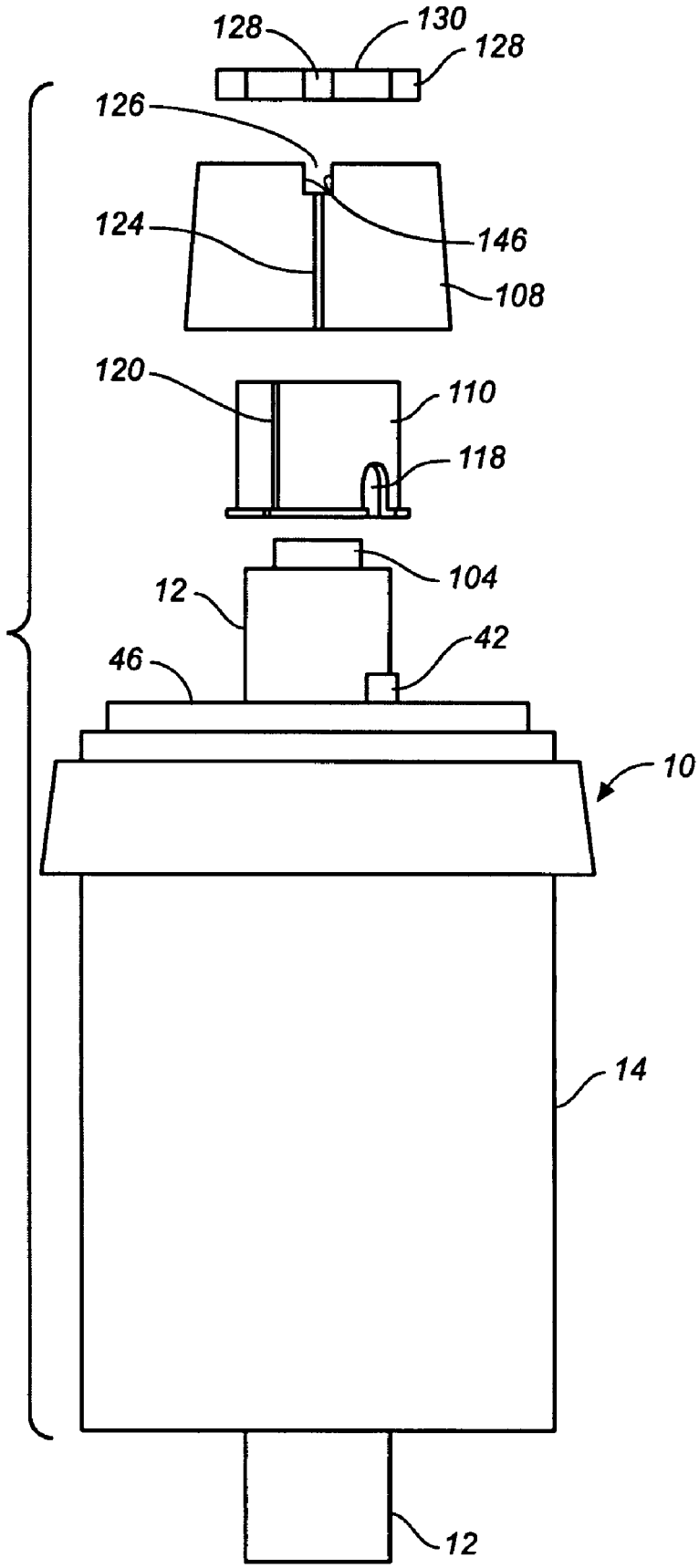
FIG. 7 is an exploded elevation view of the cross-key rotational alignment locking device shown in FIG. 6.
Figure 8:
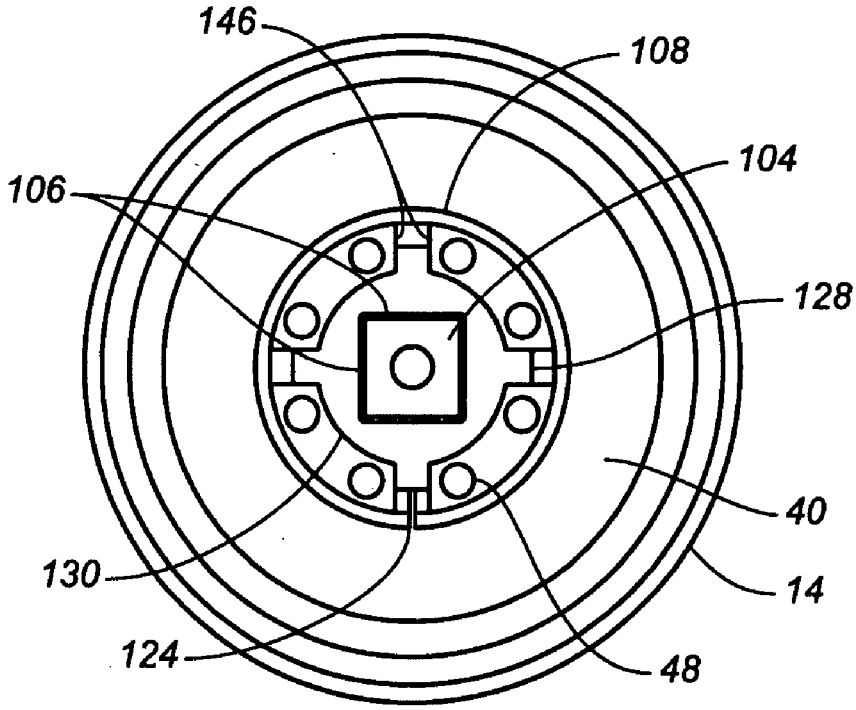
FIG. 8 is a top plan view of the cross-key rotational alignment locking device shown in FIG. 5.

Turning now to FIGS. 5-7, a symmetrical annular perimeter portion at the top edge of the shaft 12 is recessed, creating thereby annular keyway 102. Keyway 102 is open on its outer end but its inner boundary is defined by upwardly extending pilot key 104. In the preferred embodiment, pilot key 104 has four orthogonal side walls 106 forming a square-shaped cross-dimension. However, it will readily be appreciated by those with skill in the art that the pilot key could be manufactured in other shapes, such as a triangle, pentagon or other polygon, it being understood that the most desirable shapes will be symmetric.

As in the prior art, taper lock 108 is slid over and positioned around the top end of shaft 12. Once in place, the inner surface 122 of the bore 112 of taper lock 108 forms the outer boundary of annular keyway 102 discussed just above. Bolt holes 48 remain at the top of taper lock 108 to receive bolts 26 for securing the top plate 24 to taper lock 108. However, in an improvement to the prior art, bronze sleeve 110 is interposed between shaft 12 and taper lock 108 as best seen in FIG. 5. Outwardly extending annular skirt 116 at the bottom of sleeve 110 provides a seat for sleeve 110 to rest on cover plate 40. A downwardly and inwardly facing annular channel 117 at the bottom of taper lock 108 fits in mating engagement with skirt 116 as seen in FIG. 5 so that both the bottom face (not illustrated) of taper lock 108 and skirt 116 of sleeve 110 rest on cover plate 40. Skirt 116 provides a stop, independently from cover plate 40, for taper lock 108, locking sleeve 116 in place once taper lock 108 has been positioned, and conversely preventing taper lock from slipping lower than sleeve 110. In either case, were sleeve 116 permitted to rid up too high, its top edge might interfere with placement of cross-key 130 discussed below. The bottom edge of sleeve 110 and skirt 116 are interrupted by arched opening 118 as seen in FIG. 6. Opening 118 is sized to fit closely over plate key 42 on cover plate 40. Similarly, upwardly extending recess 119 in taper lock 108 is dimensioned to closely receive plate key 42. Sleeve 110, taper lock 108, and cover plate 40 are thus lacked in rotational alignment to ensure uniform movement during operation of the breaker. A longitudinal split 120 extending the full axial length of sleeve 110 allows circumferential reduction of the part so that, when taper lock 108 is compressed around it, sleeve 110 snugs around shaft 12 forming an extremely firm grip. Sleeve 110 is thus tightly sandwiched between taper lock 108 and shaft 12 when the mechanism is fully assembled as shown in FIG. 5. In the preferred embodiment, sleeve 110 is manufactured from bronze. Since bronze is a softer material than the hardened steel alloy used to form the shaft 12 and taper lock 108, it will tend to conform to any irregularities which exist or form on the surface of the shaft 12 or in the bore 112 of taper lock 106. Because of its ability to maintain more precise contact with adjoining surfaces on shaft 12 and taper lock 108, even as changes occur in those surfaces, sleeve 110 assures a firmer grip on shaft 12. Due to its greater malleability, it receives distresses that occur between shaft 12 and taper lock 108, thereby protecting the surfaces of those parts from developing undesirable "notches." Also, since bronze has a higher coefficient of expansion when subjected to heat, it will expand disproportionately faster than adjoining parts when heated. This occurs, for example, when heated rocks are fed into the mineral breaker. As heated material enters the machine, the rotor 44 heats up, heating rotor boss 22 in turn. Heat is next radiated to taper lock 108, and finally to shaft 12. The rotor 44, rotor boss 22, taper lock 108, and shaft 12 therefore heat up at disproportionate rates and, consequently, expand at different rates. In the prior art, this phenomenon loosened the fit between the taper lock and shaft. The invention has the unique advantage over the prior art that as taper lock 108 and bronze sleeve 110 heat up, bronze sleeve 110 will pick up any slack space between shaft 12 and taper lock 108. Finally, since the bronze sleeve is a relatively inexpensive part, it is easily replaced by comparison to the taper lock 108 or main shaft 12.

With continuing reference to FIGS. 5 and 6, taper lock 108 is similar to prior art taper lock 16, illustrated in FIGS. 1-4, having center bore 112, inner surface 122, and vertical split 124 which allows the circumference of taper lock 108 to be reduced when being physically compressed around sleeve 110 by the rotor boss as discussed above. When in position around shaft 12 and sleeve 110, inner surface 122 of bore 112 forms the outer boundary of annular keyway 102. However, the annular upper portion of taper lock 108 has four circumferentially-spaced slots 126 forming symmetrically distributed, radially-extending keyways sized to receive arms 128 of cross-key 130 discussed above. The upper edge 131 of sleeve 110 does not extend above the bottom surfaces 139 of slots 126 such that slots 126 are in direct and uninterrupted communication with annular keyway 102. Each slot 126 has two opposing vertical side walls 146 for abutting engagement with arms 128 of cross-key 130.

Cross-key 130 has a generally annular main body 132 (see FIG. 5) having a generally annular outer perimeter surface 134. A center aperture 136 is bounded by four orthogonal walls 138, such that the cross-dimension of aperture 136 conforms to, but is slightly larger than, pilot key 104 on the top edge portion of main shaft 12. If, in an alternate embodiment, pilot key 104 is machined to a different shape than square, as illustrated, the aperture will, of course, be manufactured to conform to the cross-dimensional shape of the pilot key. The annular main body 132 of cross-key 130 has a cross-sectional outer dimension that conforms closely to, but is slightly smaller than, the diameter of bore 112 of taper lock 108. Finally, outward extending arms 128 have a lateral width slightly smaller than the width of slots 126 in the upper portion of taper lock 108. Accordingly, and with particular reference to FIG. 5, when the sleeve 110 has been positioned around shaft 12, and taper lock 108 has been positioned around sleeve 110, cross-key 130 may be positioned with its main body 132 resting in annular keyway 102 at the top of shaft 12, with pilot key 104 received closely in aperture 136, and arms 128 extending into slots 126. The cross-key 130 is thus locked in rotational alignment with shaft 12 by the snug fit of pilot key 104 in aperture 136, and taper lock 108 is locked in rotational alignment with cross-key 130 by arms 128 closely fitting in slots 126. Hence, taper lock 108 is locked in rotational alignment with shaft 12.

As in the prior art, rotor boss 22 (see FIGS. 1-4) can still be positioned over and drawn down onto and around taper lock 108 using top plate 24 and bolts 26, 28. When fully assembled as shown in FIG. 5, the lower surfaces 139 of slots 126 are generally horizontally aligned with the bottom surface 140 of annular keyway 102, providing a uniform surface on which cross-key 130 rests. Preferably, cross-key 130 has a horizontal thickness approximating the depth of annular keyway 102 and slots 126 so that, when it is disposed in keyway 102, its top face 142 is generally aligned with the annular top surface 144 of taper lock 108. This part architecture will prevent cross-key 130 from jumping out of its position on top of shaft 12 since top plate 24 sits directly on top of taper lock 108 in the final assembly, capturing cross-key 130 in keyway 102.

The cross-key rotational alignment locking device eliminates use of prior art keyway 32 in shaft 12, as in the prior art, thereby also eliminating the need for companion keyway 36 in the bore of the taper lock. Placing the cross-key at the very top of shaft 12 also removes it up and away from the vulnerable portion of the shaft adjacent the bottom of the taper lock. A cross-key locking device according to the invention is symmetrical, thereby eliminating any vibrations which may set up as a result of an asymmetric locking arrangement, such as in the prior art. Finally, it integrates well with existing structural members of VSI mineral breakers, no modifications being required to the rotor, rotor boss, or bearing assembly, and only straightforward modifications being required to the shaft 12 and taper lock 108. If repairs to the shaft, taper lock, or rotor boss are required, disassembly of the breaker remains as straightforward as in the prior art wherein minor axial movement of the rotor boss 22 with respect to the taper lock 108 will disengage the parts.

There have thus been described certain preferred embodiments of a cross-key rotational alignment locking device. While preferred embodiments have been described and disclosed, it will be recognized by those with skill in the art that modifications are within the true spirit and scope of the invention. The appended claims are intended to cover all such modifications.

What is claimed is:

1. A rotational alignment locking device for a VSI mineral breaker, the VSI mineral breaker having a bearing cartridge assembly and a rotor rotatably connected to the bearing cartridge assembly, the rotational alignment locking device comprising:

a vertical shaft rotatably securable in the bearing cartridge assembly, said shaft having a top edge portion having an upwardly extending pilot key and a generally annular horizontal floor surrounding said pilot key;

a generally cylindrical taper lock comprising an annular top surface securable to the rotor, and a center bore having an inner surface, said shaft firmly received in said center bore;

a generally annular keyway defined by said pilot key and said horizontal floor and said inner surface of said center bore, and said top surface of said taper lock having a plurality of upwardly facing, circumferentially spaced slots in communication with said annular keyway; and a cross-key having an overall symmetrical configuration, a generally annular main body, a plurality of arms and a center aperture, said main body having a generally annular, vertical, outer perimeter surface, said plurality of arms extending radially from and disposed symmetrically about said main body, said pilot key removably inserted in said center aperture, said main body removably received in said keyway and abutting said horizontal floor of said vertical shaft, and each of said plurality of arms removably disposed in one of said slots of said top surface of said taper lock, such that said shaft is locked in rotational alignment with said taper lock.

2. The rotational alignment locking device of claim 1 wherein:

said taper lock has an upper portion, said upper portion having a generally annular vertical inside surface defining an outer boundary of said keyway.

3. The rotational alignment locking device of claim 1 wherein:

a horizontal cross-section of said pilot key has a polygonal shape.

4. The rotational alignment locking device of claim 3 wherein:

said pilot key has four orthogonal, vertical side walls, and said center aperture of said cross-key having vertical inner walls.

5. The rotational alignment locking device of claim 1 wherein:

said plurality of slots are evenly spaced circumferentially around said pilot key.

6. The rotational alignment locking device of claim 5 wherein:

said plurality of slots comprises four slots.

7. The rotational alignment locking device of claim 1 wherein:

each of said plurality of slots has at least one generally vertical side wall.

8. The rotational alignment locking device of claim 7 wherein:

each of said arms has at least one generally vertical side face abutting said vertical side wall of one of said plurality of slots.

9. The rotational alignment locking device of claim 1 wherein:

each of said arms has at least one generally vertical side face.

10. The rotational alignment locking device of claim 1 wherein:

said keyway has a bottom surface, and each of said plurality of slots has a lower face generally in planar alignment with said bottom surface of said keyway, said bottom surface and said lower faces providing a uniform surface on which said cross-key is seated.

11. The rotational alignment locking device of claim 1 wherein:

said pilot key has a top face, and said upper portion has an annular top surface generally in planar alignment with said top face of said pilot key.

12. The rotational alignment locking device of claim 1 wherein:

said pilot key has a horizontal cross-section, and said center aperture has cross-sectional dimensions closely conforming to said horizontal cross-section of said pilot key.

13. The rotational alignment locking device of claim 12 wherein:

said main body of said cross-key having a generally annular outer perimeter surface and said cross-sectional dimensions of said center aperture are polygonally shaped.

14. The rotational alignment locking device of claim 13 wherein:

said polygonally-shaped cross-sectional dimensions are square.

15. The rotational alignment locking device of claim 1 further comprising:

a cylindrical sleeve interposed between said vertical shaft and said inner surface of said bore of said taper lock.

16. The rotational alignment locking device of claim 15 wherein:

said sleeve comprises bronze.

17. The rotational alignment locking device of claim 15 wherein:

said sleeve has a longitudinal split extending the full axial length of said sleeve permitting circumferential reduction of said sleeve around said shaft when compressed by said taper lock.

18. The rotational alignment locking device of claim 15 further comprising:

said sleeve having a bottom edge having an outwardly extending annular skirt, and said taper lock having a downwardly and inwardly facing annular channel, said bottom edge in mating engagement with said annular channel such that said sleeve is prevented from slipping upward relative to said taper lock.

19. The rotational alignment locking device of claim 15 further comprising:

said vertical shaft being securable to a bearing cartridge assembly having a cover plate having an upwardly extending plate key, said sleeve having a bottom edge having an upwardly extending arched opening, said arched opening sized to fit closely over said plate key, said taper lock having an upwardly extending recess dimensioned to closely receive said plate key, such that said sleeve, said taper lock, and said cover plate are locked in rotational alignment.

20. A rotational locking device for a VSI mineral breaker having a rotor, the rotational alignment locking device comprising:

a vertical shaft having a top edge portion having an upwardly extending pilot key and a generally annular horizontal floor surrounding said pilot key;

a generally cylindrical taper lock comprising an annular top surface securable to said rotor, and a center bore having an inner surface, said shaft firmly received in said center bore, said top surface having a generally annular inside surface defining an outer boundary of a generally annular keyway defined by said pilot key and said horizontal floor and said inner surface of said center bore, and said top surface of said taper lock having a plurality of upward, facing, circumferentially spaced slots in communication with said annular keyway; and a cross-key having an overall symmetrical configuration, a generally annular main body, a plurality of arms, and a center aperture, said main body having a generally annular, vertical, outer perimeter surface, said plurality of arms extending radially from and disposed symmetrically about said main body, said pilot key removably inserted in said center aperture, said main body removably received in said keyway and abutting said horizontal floor of said vertical shaft, and each of said plurality of arms removably disposed in one of said slots of said top surface of said taper lock, such that said shaft is locked in rotational alignment with said taper lock.

21. The rotational alignment locking device of claim 20 wherein:

said pilot key has a square cross-section.

22. The rotational alignment locking device of claim 21 wherein:

said plurality of slots comprises four slots.

23. A rotational alignment locking device for a VSI mineral breaker, the VSI mineral breaker having a bearing cartridge assembly and a rotor rotatably connected to the bearing cartridge assembly, the rotational alignment locking device comprising:

a vertical shaft rotatably securable in the bearing cartridge assembly, said shaft having a top edge portion, said top edge portion having an upwardly extending pilot key and a horizontal floor defining a generally annular keyway surrounding said pilot key;

a cylindrical sleeve having a longitudinal split extending the full axial length of said sleeve;

a generally cylindrical taper lock comprising an annular top surface securable to said rotor, and a center bore, said shaft received in said center bore, said sleeve interposed in said center bore between said shaft and said taper lock, said longitudinal spilt of said sleeve permitting circumferential reduction of said sleeve around said shaft when compressed by said taper lock, and said top surface having a plurality of circumferentially spaced slot in communication with said annular keyway; and a cross-key having a generally annular main body, a plurality of arms extending radially from said main body, and a center aperture, said pilot key removably inserted in said center aperture, said main body removably received in said keyway and abutting said horizontal floor of said vertical shaft, and each of said plurality of arms removably disposed in one of said slots of said top surface of said taper lock, such that said shaft is locked in rotational alignment with said taper lock.

24. The rotational alignment locking device of claim 23 wherein:

said keyway has a bottom surface, and each of said plurality of slots has a lower face generally in planar alignment with said bottom surface of said keyway.

25. A rotational alignment locking device for a VSI mineral breaker, the VSI mineral breaker having a bearing cartridge assembly and a rotor rotatably connected to the bearing cartridge assembly, the rotational alignment locking device comprising:

a vertical shaft rotatably securable in the bearing cartridge assembly, said shaft having a top edge portion, said top edge portion having an upwardly extending pilot key and a generally annular keyway surrounding said pilot key, said keyway having a bottom surface;

a cylindrical sleeve having a longitudinal split;

a generally cylindrical taper lock comprising an annular top surface securable to said rotor, and a center bore, said shaft received in said center bore, said sleeve interposed in said center bore between said shaft and said taper lock, and said top surface having a plurality of circumferentially spaced slots in communication with said annular keyway, each of said plurality of slots having a lower face generally in planar alignment with said bottom surface of said keyway, said sleeve having an upper edge extending upward no further than said bottom surface of said keyway such that said lower faces of said slots are in direct and uninterrupted communication with said bottom surface of said keyway; and a cross-key having a generally annular main body, a plurality of arms extending radially from said main body, and a center aperture, said pilot key removably inserted in said center aperture, said main body removably received in said keyway and abutting said bottom surface of said vertical shaft, and each of said plurality of arms removably disposed in one of said slots of said top surface of said taper lock, such that said shaft is locked in rotational alignment with said taper lock.

* * * * *

UNITED STATES PATENT AND TRADEMARK OFFICE

CERTIFICATE OF CORRECTION

PATENT NO. : 7,744,302 B2
APPLICATION NO. : 11/823532
DATED : June 29, 2010
INVENTOR(S) : Damian Rodriguez It is certified that error appears in the above-identified patent and that said Letters Patent is hereby corrected as shown below:

Col. 4, line 29, "lacked" should read --locked--.
Col. 4, line 42, "taper lock 106" should read --taper lock 108--.
Col. 4, line 60, "that as" should read --that, as--.

Signed and Sealed this

Twenty-eighth Day of September, 2010

David J. Kappos

David J. Kappos
*Director of the United States Patent and Trademark Office*